US005785257A

United States Patent [19]

Furuya et al.

[11] Patent Number: 5,785,257

[45] Date of Patent: Jul. 28, 1998

[54] SWIRL TYPE FUEL INJECTION VALVE

[75] Inventors: Yuji Furuya; Kenichi Iino; Hitoshi Okuyama, all of Saitama-ken, Japan

[73] Assignee: Zexel Corporation, Tokyo, Japan

[21] Appl. No.: 507,947

[22] Filed: Jul. 27, 1995

[30] Foreign Application Priority Data

Aug. 4, 1994 [JP] Japan ..... 6-202775

[51] Int. Cl.[6] ..... F02M 51/00

[52] U.S. Cl. ..... 239/585.4; 239/585.1

[58] Field of Search ..... 239/533.1–533.4, 239/533.9, 533.12, 585.1, 585.4, 585.5; 251/129.21

[56] References Cited

U.S. PATENT DOCUMENTS 4,060,199 11/1977 Brune et al. ..... 239/488

FOREIGN PATENT DOCUMENTS 25 43 805 c2 5/1986 Germany .

3-70865 3/1991 Japan .

93/12336 6/1993 WIPO .

*Primary Examiner*—Lesley D. Morris

[57] ABSTRACT

A guide hole extending axially, a valve seat and an injection port are coaxially formed on an elongated valve body in this order toward a distal end of the valve body. A pressurized fuel is introduced into a basal end of the guide hole. A valve element is slidably received in the guide hole of the valve body. Inclined passages are formed in one of the valve element and the valve body. When the valve element is lifted, the pressurized fuel flows, as a swirling current, between a valve portion and the valve seat, proceeds toward an exit of the injection port while swirling along an inner peripheral surface of the injection port, and is injected from the injection port. When the valve element is in the fully lifted position, an orifice for restricting an amount of fuel injected from the injection port per unit time is formed between the valve portion and the valve seat.

2 Claims, 2 Drawing Sheets

SWIRL TYPE FUEL INJECTION VALVE

BACKGROUND OF THE INVENTION

This invention relates to a swirl type fuel injection valve for injecting a fuel while swirling the fuel.

As disclosed in Japanese Laid-Open Patent Application No. Hei 3-70865, a fuel injection valve of this type includes an elongated valve body and a valve element. The valve body has a guide hole extending axially, an injection port disposed on a distal end portion of the valve body, and a tapered valve seat for intercommunicating the injection port and the guide hole. A pressurized fuel is introduced into a basal end of the guide hole. The valve element is slidably received in the guide hole of the valve body. The valve element has a valve portion placed opposite the valve seat and inclined passages formed on the upstream side of the valve portion. The valve element is moved upwardly and downwardly by an electromagnetic drive means. When the valve element is moved upwardly, the valve portion of the valve element is lifted from the valve seat. Thus, the pressurized fuel flowing from an upper end of the guide hole of the valve body is injected into a combustion chamber of an engine passing through the inclined passages, a gap between the valve seat and the valve portion and the injection port. While the fuel flows through the inclined passages, it becomes a swirling current swirling about a center axis of the valve element, passes through the annular gap between the valve portion and the valve seat while swirling and proceeds toward an outer end of the injection port while swirling about a space and along an inner peripheral surface of the injection port. Consequently, the fuel is divergently injected from the outer end of the injection port at a wide angle. When the valve element is brought downwardly, the valve portion of the valve element is sat on the valve seat and the fuel injection from the injection port is finished.

In the above-mentioned conventional swirl type fuel injection valve, an angle of inclination and a sectional area of the inclined passages chiefly determine a divergent angle of the injected fuel and an occupation factor of the fuel which occupies a sectional area of the injection port. The sectional area of the injection port co-acting with the divergent angle determines an amount of fuel injected per unit time (rate of fuel injection). That is, the rate of fuel injection is increased as the sectional area of the injection port is increased.

The fuel proceeds toward the outer end of the injection port while swirling along the inner peripheral surface of the injection port. The thickness of layer of fuel at that time determines a particle size of the injected fuel. There is a limit for fulfilling the requirement of further reducing the particle size in order to improve the combustion efficiency with the use of the above-mentioned conventional fuel injection valve. The reasons are as follows.

In the fuel injection valve, once the sectional area of the injection port is determined in order to establish the rate of fuel injection, the thickness of layer of fuel at the inner peripheral surface of the injection port is spontaneously determined. That is, the layer of fuel are increased in thickness and the particle size of the injected fuel is also increased as the sectional area of the injection port and the rate of fuel injection are increased. In other words, in order to reduce the thickness of the layer of fuel, it is required to reduce the diameter of the injection port. If the diameter of the injection port is reduced, the rate of fuel injection is inevitably decreased.

SUMMARY OF THE INVENTION

It is, therefore, an object of the present invention to provide a fuel injection valve capable of comparatively easily establishing the thickness of the layer of fuel at an inner peripheral surface of an injection port irrespective of the rate of fuel injection and therefore, capable of atomizing fuel.

According to the present invention, there is provided a fuel injection valve comprising:

(a) an elongated valve body having an axially extending guide hole, an injection port, and a valve seat, the injection port being formed in a distal end portion of the valve body, the valve seat being adapted to intercommunicate the injection port and the guide hole, the guide hole, valve seat and injection port being coaxially arranged, a pressurized fuel being introduced into a basal portion of the guide hole;

(b) a valve element slidably received in the guide hole of the valve body, the valve element having a valve portion placed opposite the valve seat;

(c) inclined passage means formed in at least one of the valve element and the valve body, on the upstream side of the valve portion and adapted to cause an eddy current in the pressurized fuel;

(d) drive means for moving the valve element axially, thereby to lift the valve portion from the valve seat or cause the valve portion to sit on the valve seat; and (e) orifice means formed between the valve portion and the valve seat when the valve element is in a fully lifted position, the orifice means being adapted to restrict an amount of fuel injected from the injection port per unit time.

DETAILED DESCRIPTION OF THE EMBODIMENT

Figure 1:
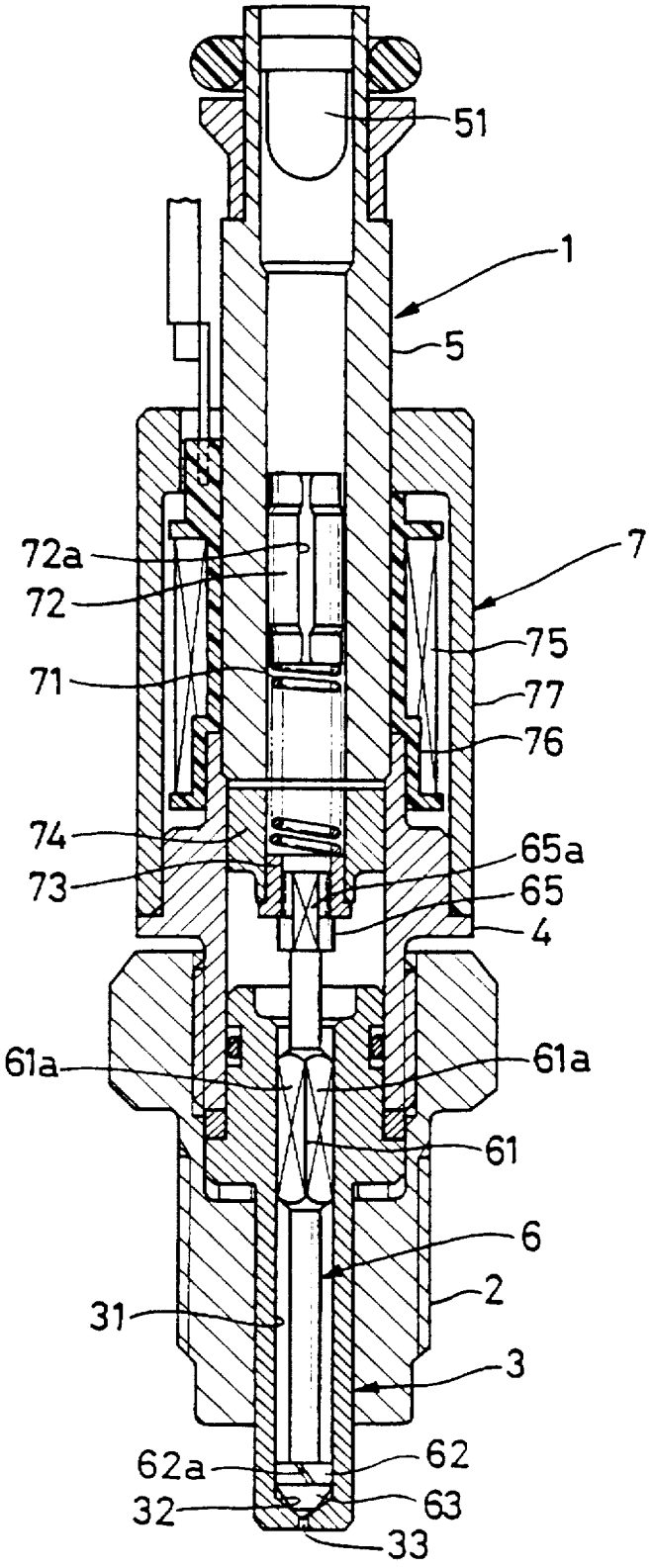
FIG. 1 is a vertical sectional view of a fuel injection valve according to one embodiment of the present invention.

One embodiment of the present invention will now be described with reference to the accompanying drawing. As shown in FIG. 1, a fuel injection valve includes an elongated hollow casing 1. This casing 1 has a holder 2, a valve body 3, a support 4 and an inlet member 5, which are all of a sleeve-like configuration and coaxially connected.

The holder 2 is fixedly threaded into a cylinder head of an engine. A valve body 3 is inserted into the holder 2. The valve body 3 is fixed by the support 4 which is threaded into an upper end portion of the holder 2. A lower end portion of the inlet member 5 is fixedly inserted into an upper end of the support 4. A fuel (for example, gasoline), which has been pressurized to a predetermined level, is introduced through an opening formed in an upper end of the inlet member 5. A filter 51 is disposed at the upper end of the inlet member 5.

The valve body 3 is allowed to project from a lower end of the holder 2 and faced with the interior of a cylinder of the engine. The valve body 3 is elongated in configuration and has a hollow interior. The valve body 3 has a guide hole 31 extending in an axial direction of the valve body 3, an injection port 33 formed in a lower end portion of the valve body 3, and a valve seat 32 having a conical surface (tapered surface). The guide hole 31, valve seat 32 and injection port 33 are arranged on a center axis of the valve body 3 and coaxial to each other.

The needle-like valve element 6 is inserted into the guide hole 31 of the valve body 3. The valve element 6 has a slide portion 61 formed on an intermediate portion thereof and another slide portion 62 formed on a lower end portion thereof. The slide portions 61 and 62 are slidably contacted with an inner peripheral surface of the guide hole 31.

A beveling 61*a* is formed on the upper slide portion 61. A gap formed between the beveling 61*a* and the inner peripheral surface of the guide hole 31 permits the passage of fuel. The lower slide portion 62 has a cylindrical configuration. A plurality of helical inclined grooves (inclined passages) 62*a* are formed in an outer peripheral surface of the slide portion 62 at equal spaces in a circumferential direction thereof. The inclined grooves 62*a* permit the passage of fuel and provides a rotational motion to the flow of fuel.

A valve portion 63 is formed on the valve element 6. The valve portion 63 is connected to a lower end of the slide portion 62. The valve element 6 is moved downwardly to cause the valve portion 63 to sit on the valve seat 32, thereby to close the injection port 33. When the valve element 6 is moved upwardly to cause the valve portion 63 to lift from the valve seat, the injection port 33 is opened.

The valve element 6 is controlled by an electromagnetic drive means 7. This electromagnetic drive means 7 has a compression coil spring 71 for biasing the valve element 6 downwardly. An upper portion of the coil spring 71 is received in the inlet member 5. An upper end of the coil spring 71 is in abutment with a spring retainer 72 which is secured to the inlet member 5. The spring retainer 72 has a sleeve-like configuration and is provided with a slit 72*a* extending axially. The spring retainer 72 is press-fitted in the inlet member 5. A head portion 65 is formed on an upper end of the valve element 6. A sleeve-like spring retainer 73 is secured to the head portion 65. A lower end of the coil spring 71 is in abutment with the spring retainer 73. In order to permit the passage of fuel, a beveling 65*a* is formed on the head portion 65.

The electromagnetic drive means 7 further includes a sleeve-like armature 74 secured to the spring retainer 73, an electromagnetic coil 75 attached to a lower portion of the inlet member 5 through a resin collar 76, and a cover 77 for covering the electromagnetic coil 75. The armature 74 is slidably received in the support 4. A lower portion of the coil spring 71 is received in the armature 74. A thin upper end of the support 4 is formed of a non-magnetic material such as SUS or the like. The remaining part of the support 4, the inlet member 5, the armature 74 and the cover 77 are formed of a magnetic material.

With the above-mentioned construction, when a current is supplied to the electromagnetic coil 75, the armature 74 is moved upwardly against the coil spring 71 by a magnetic force generated by the electromagnetic coil 75. In response to the upward movement of the armature 74, the valve element 6 secured to the armature 74 is moved upwardly. As a consequence, the valve portion 63 of valve element 6 is lifted from the valve seat 32, and the injection port 33 is opened. As a consequence, the fuel of the predetermined pressure level introduced through the inlet member 5, armature 74, spring retainer 73 and support 4 passes through the guide hole 31 of the valve body 3 and the inclined grooves 62*a* of the valve element 6. The fuel becomes a swirling current when it passes through the inclined grooves 62*a*, flows through a gap between the valve seat 32 and the valve portion 63 of the valve element 6 while swirling, proceeds toward an outer end of the injection port 33 while swirling along an inner peripheral surface of the injection port 33, and is injected, in a divergent fashion, into a combustion chamber of the engine from the outer end of the injection port 33.

The armature 74 is brought into abutment with a lower end face of the inlet member 5. By this, the fully lifted amount of the valve portion 63 of the valve element 6 is determined. When the supply of current to the electromagnetic coil 75 is stopped, the valve element 6 is moved downwardly by the coil spring 71 and the valve portion 63 is caused to sit on the valve seat 32. Thus, the fuel injection from the injection port 33 is finished.

Next, the valve portion 63 of the valve element 6 will be described in detail with reference to FIG. 2. The valve portion 63 has a first tapered surface 63*a* on the lower side and a second tapered surface 63*b* on the upper side. A taper angle $\Theta_1$ of the first tapered surface 63*a* is larger than a taper angle $\Theta_0$ of the valve seat 32, whereas a taper angle $\Theta_2$ of the second tapered surface 63*b* is smaller than a taper angle $\Theta_0$ of the valve seat 32. An annular line formed by an intersection between the first tapered surface 63*a* and the second tapered surface 63*b* and its neighborhood area are served as an abutment portion 63*c* to be abutted with the valve seat 32.

Figure 2:
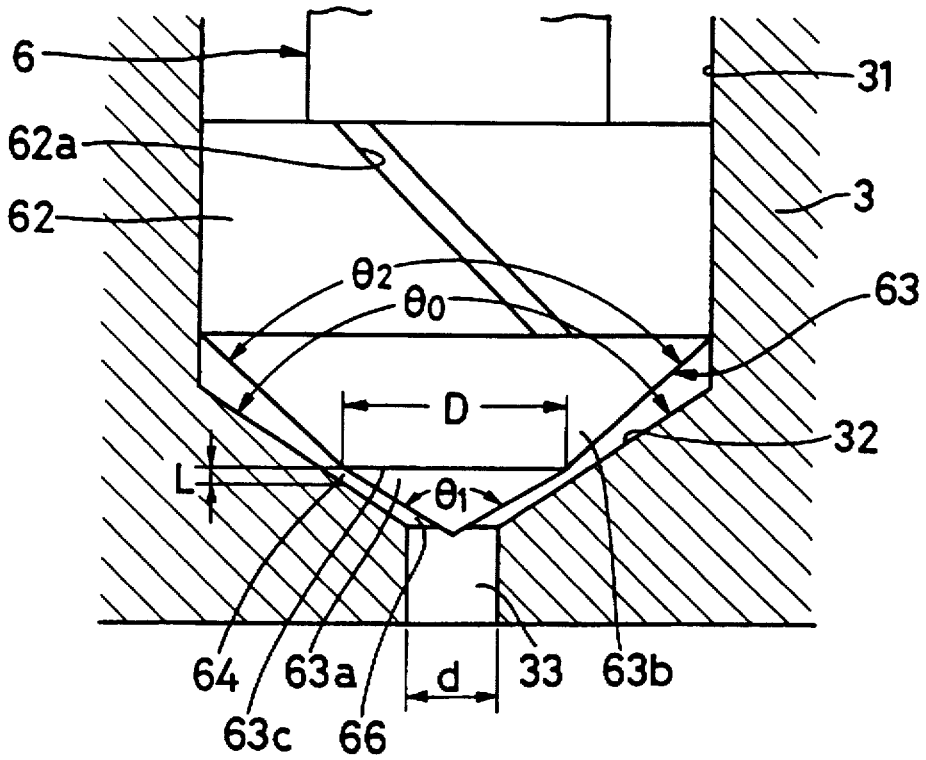
FIG. 2 is an enlarged sectional view of an important portion of the fuel injection valve.

FIG. 2 shows the valve element 6 which is now in the fully lifted position. If, in the foregoing state, a sectional area of an annular gap 65 between the valve seat 32 and the abutment portion 63*c* is represented by $A_0$; a sectional area 66 between a peripheral edge (line formed by an intersection between the valve seat 32 and the inner peripheral surface of the injection port 33) of an inner end of the injection port 33 of the valve seat 32 and the first tapered surface 63*a* of the valve portion 63, by $A_1$; a sectional area of the injection port 33, by B, respectively, the following expression is established.

$$B \geqq A_1 > A_0 \quad (1)$$

If the fully lifted amount of the valve element 6 is represented by L; the diameter of the abutment portion 63*c*, by D; and the diameter of the injection port, by d, respectively, the sectional areas $A_0$ and $A_1$ can be expressed by the following equations.

$$A_0 = \pi D L \sin(\Theta_0/2) \quad (2)$$

$$A_1 = \pi d(L+L_0)\sin(\Theta_1/2) \quad (3)$$

$$B = \pi d^2/4 \quad (4)$$

In the above equations, $L_0$ represents a distance (in the lifting direction) between the peripheral edge of the inner end of the injection port 33 and the first tapered surface 63*a* when the valve portion 63 of the valve element 6 is in the sitting position. This distance $L_0$ can be obtained by the following equation.

$$L_0 = (D-d)[\cot(\Theta_0/2) - \cot(\Theta_1/2)]/2 \quad (5)$$

As apparent from the above expression (1), the sectional area $A_0$ of the gap 65 is smaller than the sectional area of the fuel passage on the downstream side. Also, the sectional area $A_0$ of the gap 65 is smaller than the total of the sectional areas of all of the inclined grooves 62*a* and smaller than the remaining part of the passage on the upstream side. For this reason, the gap 65 forms an orifice means when the valve element 6 is in the fully lifted position. As a consequence, on behalf of the injection port 33, the gap 65 can determine the fuel injection amount per unit time (injection rate). Accordingly, the size of the area of the injection port 33 and the diameter of the injection port 33 can be comparatively freely established irrespective of (or independent of) the fuel injection rate. Attention should be paid to the fact that the layer of fuel flowing along the inner peripheral surface of the injection port 33 can be reduced in thickness as the injection port 33 is increased in size, and as a consequence, the particles of fuel injected through the injection port can be reduced.

The sectional area is gradually increased ($A_O$ to $A_1$) from the gap 65 to the gap 66. For this reason, during the time the fuel flows along the valve seat 32 until it reaches the injection port 33, the swirling current is growing. Since the growth of the swirling current of the fuel enhances the flow rate of the fuel, the layer of fuel flowing through the injection port 33 can be further reduced in thickness. Thus, the fuel can be more atomized.

The present invention is not limited to the above embodiment and many changes can be made in accordance with necessity. For example, the inclined passages for causing the swirling current of fuel may be inclined through-holes formed in the slide portion 62 or they may be inclined grooves formed in the inner peripheral surface of the guide hole 31 of the valve body 3 in such a manner as to face with the slide portion 62.

It is also possible that an abutment portion constituted of a tapered surface having the same taper angle as the valve seat is formed between the first and second tapered surfaces 63*a* 63*b* so that the abutment portion may surface-contact the valve seat 32.

Also, by making the sectional area $A_1$ of the gap 66 smallest the fuel passages when the valve element 6 is in the fully ed position, this gap may be served as the orifice means.

What is claimed is:

1. A fuel injection valve comprising:

(a) an elongated valve body having an axially extending guide hole, an injection port, and a valve seat, said injection port and said guide hole, said guide hole, valve seat and injection port being coaxially arranged, a pressurized fuel being introduced into a basal portion of said guide hole;

(b) a valve element slidably received in said guide hole of said valve body, said valve element having a valve portion placed opposite said valve seat;

(c) an inclined passage formed in at least one of said valve element and said valve body, on the upstream side of said valve portion and adapted to cause an eddy current in said pressurized fuel;

(d) a driver for moving said valve element axially, thereby to lift said valve portion from said valve seat or cause said valve portion to sit on said valve seat; and (e) an annular gap formed between said valve portion and said valve seat when said valve element is in a fully lifted position, where a sectional area of the annular gap at the fully lifted position of the valve element is smaller than a sectional area of the injection port;

(f) wherein an orifice provided by the annular gap determines a fuel injection amount per unit time.

2. A fuel injection valve according to claim 1, wherein said valve portion comprises:

a first tapered surface and a second tapered surface arranged in a direction away from said injection port, a tapered angle of said first tapered surface being larger than a tapered angle of said valve seat, a tapered angle of said second tapered surface being smaller than the tapered surface of said valve seat, an annular abutment portion abutting against said valve seat formed on a boundary between said first and second tapered surfaces, an annular first gap between said annular abutment portion and said valve seat provided as said orifice means, the following expression being established;

$$B \geqq A_1 > A_0,$$

where a sectional area of said first gap is represented by $A_O$, a sectional area of an annular second gap between a peripheral edge of an inner end of said injection port and said first tapered surface of said valve body is represented by $A_1$ and a sectional area of said injection port is represented by B.

* * * * *

UNITED STATES PATENT AND TRADEMARK OFFICE

CERTIFICATE OF CORRECTION

PATENT NO. : 5,785,257

DATED : July 28, 1998

INVENTOR(S) : Furuya et al.

It is certified that an error appear in the above-identified patent and that said Letters Patent is hereby corrected as shown below:

Claim 1, line 3, after "valve seat," please insert --said injection port being formed in a distal end portion of said valve body, said valve seat being adapted to intercommunicate--

Signed and Sealed this

Twenty-ninth Day of December, 1998

*Attest:*

Bruce Lehman

BRUCE LEHMAN

*Attesting Officer*

*Commissioner of Patents and Trademarks*